United States Patent [19]

Billiet

[11] Patent Number: 4,802,932

[45] Date of Patent: Feb. 7, 1989

[54] FLUORIDE-FREE FLUX COMPOSITIONS FOR HOT GALVANIZATION IN ALUMINUM-MODIFIED ZINC BATHS

[76] Inventor: Jeannine Billiet, Oudstrijderslaan, 3 (bus 26) B-9600 Ronse, Belgium

[21] Appl. No.: 127,293

[22] PCT Filed: Mar. 3, 1987

[86] PCT No.: PCT/BE87/00003

§ 371 Date: Nov. 4, 1987

§ 102(e) Date: Nov. 4, 1987

[87] PCT Pub. No.: WO87/05337

PCT Pub. Date: Sep. 11, 1987

[30] Foreign Application Priority Data

Mar. 4, 1986 [LU] Luxembourg ..... 86339

[51] Int. Cl.[4] ..... B23K 35/34

[52] U.S. Cl. ..... 148/23; 148/26

[58] Field of Search ..... 148/23, 26

[56] References Cited

U.S. PATENT DOCUMENTS

| | | | |
|---|---|---|---|
| 3,350,244 | 10/1967 | Shanklin | 148/26 |
| 3,814,637 | 6/1974 | Scott | 148/26 |
| 4,042,731 | 8/1977 | Chay | 148/23 |
| 4,062,703 | 12/1977 | Vastag | 148/23 |
| 4,647,308 | 3/1987 | Beal | 148/26 |

*Primary Examiner*—Peter D. Rosenberg

*Attorney, Agent, or Firm*—Fishman, Dionne & Cantor

[57] ABSTRACT

The disclosed flux compositions contain by weight: from 80 to 90% of $ZnCl_2$, from 10 to 20% of $NH_4Cl$ and, based on the weight of $ZnCl_2+NH_4Cl$, from 0.01 to 5% of a wetting agent, from 0 to 5% of a forming agent, from 0 to 5% of a soluble salt of rare earths. The flux compositions according to the invention may be used as galvanization flux in the dry process with baths containing more than 0.15% of aluminum, particularly for baths of galvanization alloy containing 5% of aluminum, 95% of zinc and Mischmetall additions.

18 Claims, No Drawings

FLUORIDE-FREE FLUX COMPOSITIONS FOR HOT GALVANIZATION IN ALUMINUM-MODIFIED ZINC BATHS

The present invention relates to fluoride-free flux compositions preferably intended for hot galvanization in zinc baths having a high aluminium content (≧0.15%), with or without other elements.

"Conventional" hot galvanization by dipping the objects to be galvanized in a molten zinc bath requires extensive surface preparation, which is carried out in a plurality of stages, namely: degreasing, stripping, rinsing, fluxing and drying.

The fluxing operation can be carried out dry. In that case, it consists of depositing a film of flux on the pieces to be galvanized: this deposit is applied by dipping the pieces in a flux solution, followed by suitable drying (this being called the prefluxing method).

The basic products employed in fluxing are generally zinc chloride, ammonium chloride and mixed chlorides such as $ZnCl_2.2NH_4Cl$ and $ZnCl_2.3NH_4Cl$.

It is well known that a higher content of aluminium in zinc baths favours hot galvanization because it slows down the formation of the various layers of Fe-Zn alloy, giving rise to a coating having well-defined mechanical properties, especially a high ductility.

Furthermore, coatings having a high aluminium content, such as Galvalume (55% Al-43.5% Zn-1.5% Si), Galfan (5% Al-95% Zn-0.05% Mischmetall), Supergalva (Al: 0.1 to 30%-Na: 0 to 1.0%-Mg: 0 to 5%-Zn: balance) and others, are known to have better corrosion resistance while affording the same cathodic protection as 100% zinc coatings.

The fluxes employed in the "conventional" hot galvanization, either as a covering flux in so-called wet galvanization or as an aqueous flux in so-called dry galvanization, in no way prove satisfactory when they are employed on, or with, zinc baths containing 0.15% or more of aluminium.

The special fluxes which have been developed for use with zinc baths containing a higher percentage of aluminium usually contain not insignificant percentages of fluorides. Examples of the use of fluorides in galvanization fluxes are given in U.S. Pat. Nos. 1,914,269 and 4,496,612. These fluorides are very troublesome because of their acute toxicities. They present major problems both in respect of workplace hygiene and in respect of depollution. Furthermore, the use of aqueous flux containing fluorides sometimes requires the addition of acid, because of the low solubility of the majority of fluorides in water. An excessively acid flux ultimately leads to a flux polluted with iron, which has an adverse effect on the galvanization.

The flux compositions according to the present patent application do not contain fluorides but nevertheless make it possible to achieve correct galvanization, especially by the dry method (aqueous flux), when using zinc baths containing 0.15% or more of aluminium.

The present invention is based on the unexpected fact that flux compositions containing zinc chloride and ammonium chloride in well-defined ratios, in the presence of a wetting agent and, preferably, a foaming agent and/or a soluble rare earth salt, make it possible to achieve the same result, or a better result, in hot galvanization using zinc baths with a high aluminium content as do flux formulations containing fluorides, without however having the disadvantages of the latter.

The compositions according to the invention contain 80 to 90% of zinc chloride, 10 to 20% of ammonium chloride and—based on the total of these two products—0.01 to 5% of a preferably nonionic wetting agent, 0 to 5% of a foaming agent and/or 0 to 5% of a soluble rare earth salt.

The foaming agent can be of the polyalcohol type such as glycerol, sorbitol, mannitol, pentaerythritol and others, or a polyglycol or molecules such as hexamethylenetetramine or tetradecylamine etc. (which can at the same time serve as attack-limiting compounds) or a combination of these products.

Amongst the soluble rare earth salts, the salts of La or of Ce are preferred when working with the Galfan alloy.

In general, flux solutions having the compositions mentioned are prepared by dissolving the mixtures in water in an amount of 100 g/l to 1250 g/l depending on the dimensions and characteristics of the pieces to be galvanized. These solutions can be used at ambient temperature or can be heated.

The pieces to be galvanized, which are first degreased, stripped and rinsed, are then immersed in the flux solutions for periods varying from a few seconds to a few minutes or more, depending on their dimensions. The fluxing action can be continuous, in the case of more or less automated systems such as are employed in wire-drawing or pipemaking factories, or discontinuous, such as for tailormade galvanization.

After the fluxing, drying of the flux deposited as a film on the pieces to be galvanized can be carried out. In that case, the temperature of the pieces during drying must not exceed 200° C.

The efficacy of the flux compositions according to the invention has been demonstrated by the following experiments which are given solely by way of explanation and without implying any limitation.

EXAMPLE NO. 1

Steel samples of size 4×10 cm and thickness 1 mm were treated as follows:

(1) Degreasing: 5 minutes of an ultrasonic treatment in perchloroethylene.

(2) Stripping: 10 minutes in a mixture of ⅔ of 10.5N (380 g/l) hydrochloric acid, ⅓ of water, 0.1% of wetting agent and 0.1% of an attack-limiting agent.

(3) Rinsing: 30 seconds in non-running water.

(4) Fluxing: 10 to 30 seconds in a flux having the following composition: 98% of $ZnCl_2$+2% $NH_4Cl$+0.5% of Despelan® (commercial wetting agent), at a concentration of 500 g/l in water, heated to 75° C.

(5) Drying: 10 minutes in an oven at 120°–130° C.

(6) Galvanization: 2 minutes in an alloy bath of 95% Zn/5% Al+0.05% Mischmetall at 450°–460° C. Before dipping and withdrawing the piece, the surface of the bath is freed from oxides present in the form of ashes.

EXAMPLE NOS. 2 TO 6

Example Nos. 2 to 6 repeat Example No. 1 except that the flux compositions vary as indicated in the table below:

TABLE 1

| Example | Flux composition $ZnCl_2$ | $NH_4Cl$ | Despelan ® | Concentration |
|---|---|---|---|---|
| No. 1 | 98% | 2% | 0.5% | 500 g/l |
| No. 2 | 96% | 4% | 0.5% | 500 g/l |
| No. 3 | 90% | 10% | 0.5% | 500 g/l |
| No. 4 | 85% | 15% | 0.5% | 500 g/l |
| No. 5 | 82% | 18% | 0.5% | 500 g/l |
| No. 6 | 73% | 27% | 0.5% | 500 g/l |

The coatings obtained in Example Nos. 3, 4 and 5 proved to be complete, glossy and much smoother than those of Example Nos. 1, 2 and 6.

EXAMPLE NO. 7

Example No. 1 is repeated with a flux composition of 87% $ZnCl_2$ and 13% $NH_4Cl$ in the absence of a wetting agent. The coating obtained is of markedly lower quality than that of Example Nos. 3, 4 and 5.

EXAMPLE NO. 8

Example No. 1 is repeated with a flux composition of 87% $ZnCl_2$+13% $NH_4Cl$ and 2% of Despelan ® as a wetting agent. The coating is of equivalent quality to that of Examples 3, 4 and 5.

EXAMPLE NO. 9

Example No. 1 is repeated with a flux composition of 87% $ZnCl_2$, 13% $NH_4Cl$+0.5% Despelan ® dissolved in an amount of 1000 g/l. The coating was of good quality.

EXAMPLE NOS. 10 TO 14

Example No. 1 is repeated, but with the compositions and flux concentrations indicated in the table below:

TABLE 2

| Example | Flux composition $ZnCl_2$ | $NH_4Cl$ | Other | Wetting agent | Foaming agent | Concentration |
|---|---|---|---|---|---|---|
| No. 10 | 87% | 13% | — | 0.5% | — | 500 g/l |
| No. 11 | 87% | 13% | — | 0.5% | 2% | 333 g/l |
| No. 12* | 91% | 4% | 5% NaF | — | — | 240 g/l |
| No. 13 | 97.5% | 1.5% | 1.5% $NH_4HF_2$ | — | — | 480 g/l |
| No. 14 | 87% | 13% | 0.5% $LaCl_3x$ $H_2O$ | 0.5% | — | 500 g/l |

*pH adjusted to 2 by adding hydrochloric acid.

A jury of 8 persons unanimously judged the coatings of Example Nos. 10, 11 and 14 to be superior to those of Example Nos. 12* and 13, which reproduce Example Nos. 8 and 18 of U.S. Pat. No. 4,496,612.

I claim:

1. Fluoride free flux composition for hot galvanization using aluminium modified molten zinc baths comprising by weight:

(1) 80 to 90% of $ZnCl_2$;

(2) 10 to 20% of $NH_4C$; and based on the combined weight of the $ZnCl_2$ and the $NH_4Cl$, further including;

(a) 0.01 to 5% of a wetting agent.

2. Flux compositions according to claim 1 wherein said foaming agent is selected from the group comprising:

a polyalcohol, a polyglycol, hexamethylenetetramine, decylamine, or any combination thereof.

3. The flux composition of claim 2 wherein said polyalcohol is selected from the group comprising:

glycerol, sorbitol, mannitol or pentaerythritol.

4. The flux composition of claim 1 wherein:

said flux composition is in an aqueous solution.

5. The flux composition of claim 4 wherein:

said aqueous flux composition includes between about 100 grams/liter and about 1250 grams/liter of said flux composition.

6. The flux composition of claim 2 wherein:

said flux composition is in an aqueous solution.

7. The flux composition of claim 6 wherein:

said aqueous flux composition includes between about 100 grams/liter and about 1250 grams/liter of said flux composition.

8. A method for hot galvanization of metal using aluminium modified molten zinc baths comprising the steps of:

fluxing a metal piece with a fluoride free flux having a composition by weight of;

(1) 80 to 90% $ZnCl_2$, (2) 10 to 20% $NH_4Cl$, and based on the combined weight of the $ZnCl_2$ and $NH_4Cl$, (a) 0.01 to 5% wetting agent; and galvanizing the metal piece in a galvanization aluminium modified molten zinc bath.

9. The method of claim 8 wherein:

said galvanization alloy bath includes more than about 0.15% aluminium.

10. The method of claim 8 wherein:

said galvanization alloy bath includes about 5% aluminium, about 95% zinc and additions of Mischmetall.

11. The flux composition of claim 1 including:

0 to 5% of a soluble rare earth salt based on the combined weight of the $ZnCl_2$ and $NH_4Cl$.

12. The flux composition of claim 1 wherein:

said wetting agent is nonionic.

13. The flux composition of claim 1 including:

0 to 5% of a foaming agent based on the combined weight of the $ZnCl_2$ and $NH_4Cl$.

14. The flux composition of claim 7 including:

0 to 5% of a foaming agent based on the combined weight of the $ZnCl_2$ and $NH_4Cl$.

15. The method of claim 8 wherein said flux composition further includes:

0 to 5% of a soluble rare earth salt based on the combined weight of the $ZnCl_2$ and $NH_4Cl$.

16. The method of claim 8 wherein said flux composition further includes:

0 to 5% of a foaming agent based on the combined weight of the $ZnCl_2$ and $NH_4Cl$.

17. The method of claim 11 wherein said flux composition further includes:

0 to 5% of a foaming agent based on the combined weight of the $ZnCl_2$ and $NH_4Cl$.

18. The method of claim 8 wherein:

said wetting agent is nonionic.

* * * * *

UNITED STATES PATENT AND TRADEMARK OFFICE

CERTIFICATE OF CORRECTION

PATENT NO. : 4,802,932

DATED : February 7, 1989

INVENTOR(S) : Jeannine Billiet

It is certified that error appears in the above-identified patent and that said Letters Patent is hereby corrected as shown below:

Claim 2, line 1, change "1" to --13--.

Signed and Sealed this

Tenth Day of December, 1991

*Attest:*

HARRY F. MANBECK, JR.

*Attesting Officer*

*Commissioner of Patents and Trademarks*